US007232046B1

(12) United States Patent
Stassi

(10) Patent No.: US 7,232,046 B1
(45) Date of Patent: Jun. 19, 2007

(54) PRESSURIZED DISPENSER FOR BEVERAGE BOTTLE

(76) Inventor: Len Stassi, 57 Maford Oakley Square, London (GB) NW1 1NX ( * ) Notice: Subject to any disclaimer, the term of this patent is extended or adjusted under 35 U.S.C. 154(b) by 450 days.

(21) Appl. No.: 10/847,029

(22) Filed: May 17, 2004

(51) Int. Cl.
*B65D 83/00* (2006.01)

(52) U.S. Cl. ..... 222/400.8; 222/209; 222/401; 141/64

(58) Field of Classification Search ..... 222/209, 222/400.8, 401; 141/14, 15, 64
See application file for complete search history.

(56) References Cited

U.S. PATENT DOCUMENTS 2,060,512 A * 11/1936 Magill ..... 222/400.8
2,061,240 A * 11/1936 Leins ..... 222/399
D277,537 S 2/1985 Merl et al.
D296,522 S 7/1988 Schneider
4,838,324 A 6/1989 Boyd
5,010,928 A 4/1991 Ballas
D327,647 S 7/1992 Lemme
5,385,276 A * 1/1995 Yen-Tang ..... 222/400.8
5,740,949 A 4/1998 Park
6,279,787 B1 8/2001 Kim
6,289,784 B1 9/2001 Park et al.

* cited by examiner

*Primary Examiner*—J. Casimer Jacyna

(57) ABSTRACT

An apparatus securable to a top opening of a beverage bottle for selectively dispensing fluid therefrom includes a body that has a plurality of vertically aligned chambers, a spout extending outwardly from one of the plurality of chambers and a bellow section disposed within the body. The bellow section cooperates with the spout for moving between expanded and contracted positions has a passageway extending substantially parallel to the axis for selectively drawing air outwardly from the reservoir. The apparatus also includes a plunger section slidably connected to the body for operably introducing pressure downwardly from another of the plurality of chambers. A lever is adjustably engaged with the bellow section and is movable between compressed and released positions for selectively releasing pressure from the reservoir respectively.

12 Claims, 5 Drawing Sheets

PRESSURIZED DISPENSER FOR BEVERAGE BOTTLE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a dispenser for carbonated beverage bottles and, more particularly, to a pressurized dispenser including a bellow section in fluid communication with a spout.

2. Prior Art

Many carbonated beverages are packaged in large containers having a screw cap engaged with a screw-threaded neck. When the container is opened by unscrewing the cap to enable the contents of the container to be poured into a container for consumption, the carbonated beverage will become "flat" since the void space in the upper part of the beverage container enables the carbonation gas of the carbonated beverage to separate from the beverage and fill the void space even with the normally provided screw threaded cap being tightly replaced.

Efforts have been made to overcome this problem by pressurizing the beverage container with such devices usually including a combination closure cap, pump and valve all of which remain with the beverage container thus requiring a pressurizing device for each beverage container from which contents are to be consumed.

Before the advent of plastic containers, the amount of soft drink in a typical glass bottle was twelve fluid ounces. This amount is one or two servings, and the contents were usually completely consumed upon opening the bottle. If the contents weren't completely consumed before it went flat, the amount wasted wasn't significant for anyone to complain about.

Two and three liter bottles of soft drink have the potential problem of wasting unacceptable amounts of beverage. When the bottle leaves the bottling plant, it is pressurized at about fifteen psi as a result of the carbonation process. Upon opening the bottle, this pressure is lost, and causes the beverage to begin fizzing. With the bottle recapped, fizzing continues until the fizzing action itself repressurizes the bottle again to fifteen psi.

The concentration of beverage carbonation decreases then, each time this process is repeated. The loss of pressure above the liquid is what triggers the fizzing. Systems exist today to restore this pressure using canisters of compressed carbon dioxide.

Accordingly, a continuing need remains to provide a pressurized dispenser for beverage bottles in light of prior art.

BRIEF SUMMARY OF THE INVENTION

In view of the foregoing background, it is therefore an object of the present invention to provide a pressurized dispenser for beverage bottles to prevent the inconvenient loss of carbonation. These and other objects, features, and advantages of the invention are provided by an apparatus securable to a top opening of a carbonated beverage bottle for selectively dispensing fluid therefrom.

The apparatus includes a body that has a substantially cylindrical shape and a centrally disposed longitudinal axis. The body further has a plurality of chambers vertically aligned along the axis. The apparatus further includes a spout extending outwardly from one of the plurality of chambers and is in fluid communication therewith. The spout preferably has a longitudinal axis offset at an oblique angle from the axis of the body so that the beverage can be effectively directed towards a reservoir.

The present invention also includes a bellow section disposed within the body and includes a conduit having opposed end portions disposed adjacent one chamber and within a beverage bottle reservoir respectively. The bellow section cooperates with the spout for moving between expanded and contracted positions so that air can be drawn upwardly through the conduit and expelled through the spout. The bellow section further has a passageway extending substantially parallel to the axis for selectively drawing air outwardly from the reservoir.

The bellow section preferably includes a slidable stop member that has a longitudinal axis aligned with the axis of the body. A helical spring is disposed about the stop member, causing the stop member to return downwardly towards a rested position when the lever is released after it is compressed. The stop member may have a cradle formed generally medially thereof for advantageously receiving the first flange section of the lever (described hereinbelow). The bellow section preferably further includes a gasket connected to a lower portion of the stop member and is removably engageable with an upper portion of the conduit.

The apparatus also includes a plunger section slidably connected to the body for operably introducing pressure downwardly from another one of the plurality of chambers and through the one chamber and into the reservoir underneath the bellow section. The plunger section may further include a plunger that has a substantially planar top surface including a plate for defining a lower surface thereof.

The plunger section may also includes a guide member extending downwardly from a top portion of the body and substantially parallel to the axis so that the plunger can pass through the guide member. A washer is connected to the plate and has an outer perimeter engageable with an inner surface of the body so that air can be effectively compressed or released between the chamber and the reservoir.

The present invention further includes a lever including a first flange portion adjustably engaged with the bellow section and further including a second flange portion extending outwardly from the body. The second flange portion is movable between compressed and released positions for selectively releasing pressure from the reservoir respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
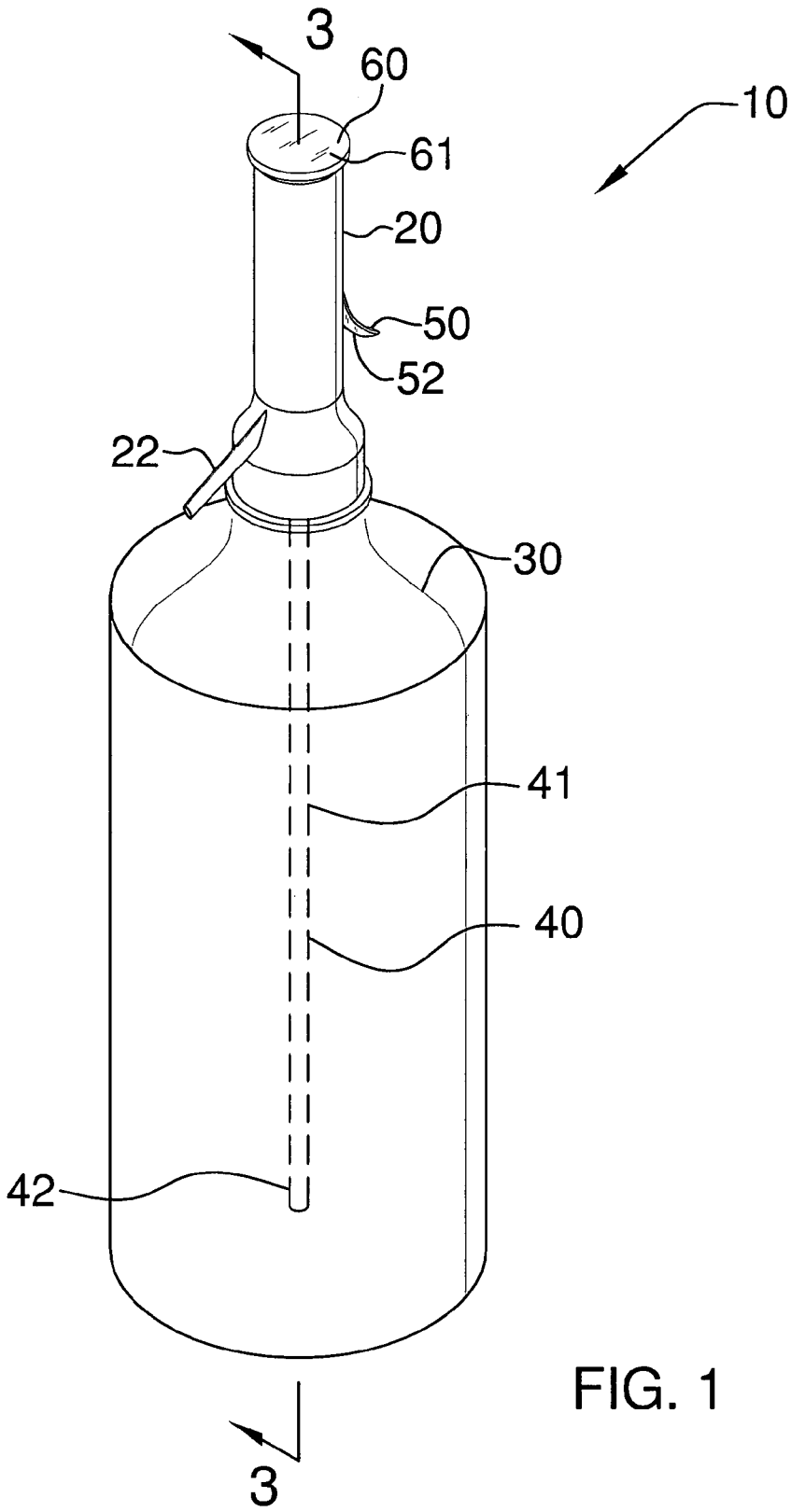
FIG. 1 is a perspective view showing a pressurized dispenser for beverage bottles, in accordance with the present invention.
Figure 2:
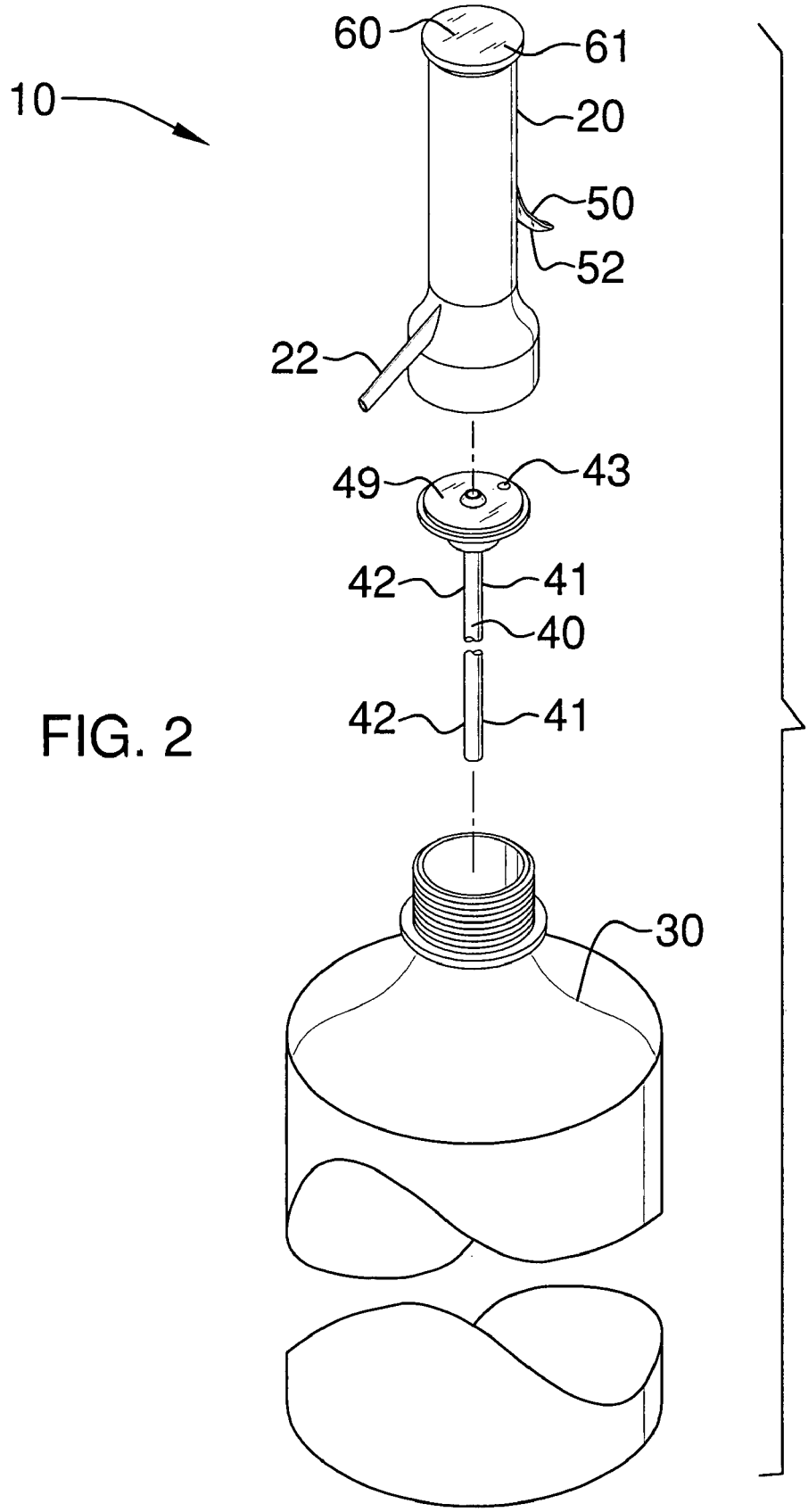
FIG. 2 is an exploded, partial perspective view of the apparatus shown in FIG. 1.
Figure 3:
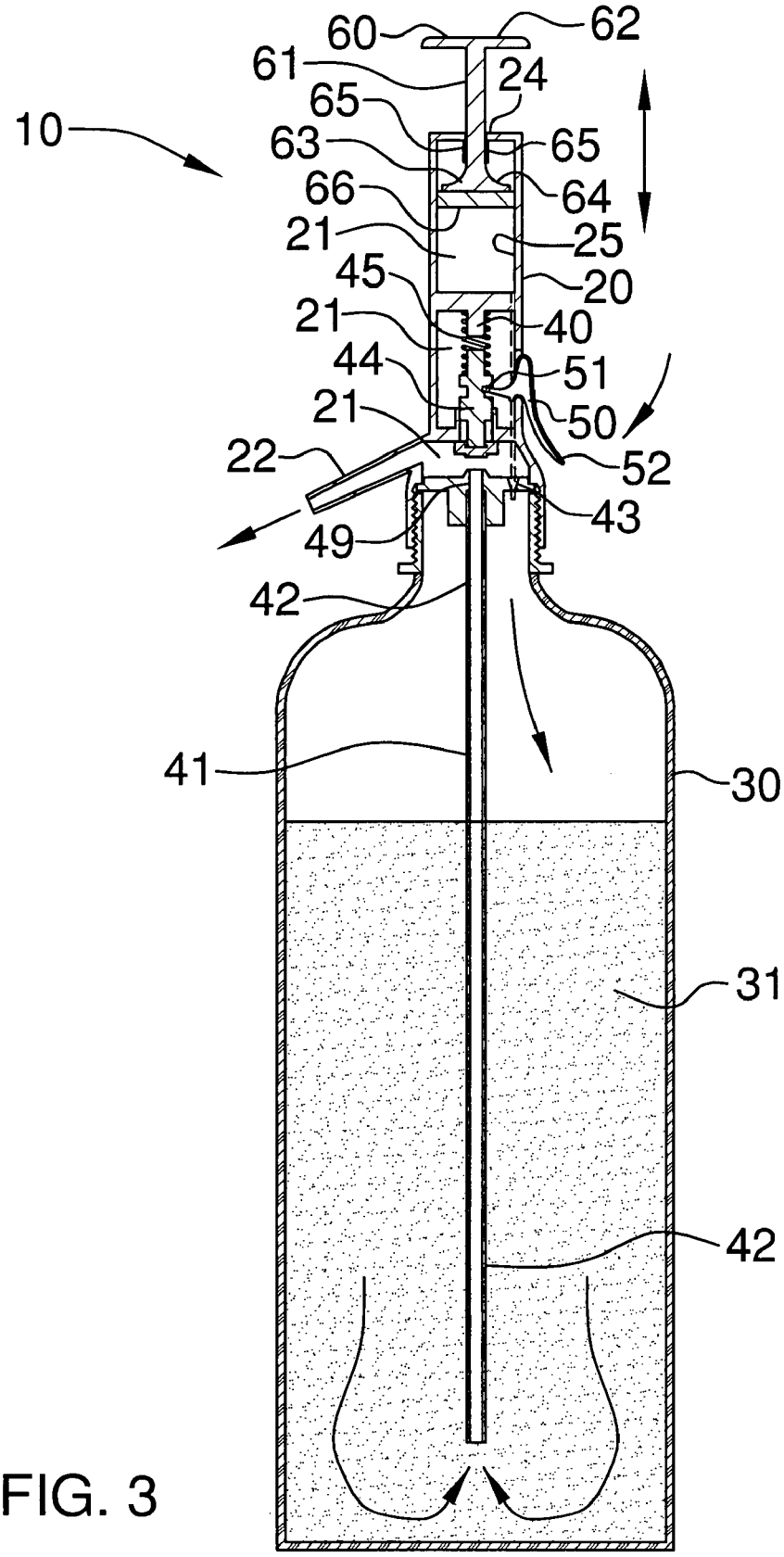
FIG. 3 is a cross-sectional view of the apparatus shown in FIG. 1, taken along line 3—3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a pressurized dispenser for beverage bottles. It should be understood that the apparatus 10 may be used to dispense many different types of beverages and should not be limited to only carbonated beverages.

Referring initially to FIG. 1, the apparatus 10 includes a body 20 that has a substantially cylindrical shape and a centrally disposed longitudinal axis. The body 20 further has a plurality of chambers 21 vertically aligned along the axis. The apparatus 10 further includes a spout 22 extending outwardly from one of the plurality of chambers 21 and is in fluid communication therewith. The spout 22 has a longitudinal axis offset at an oblique angle from the axis of the body 20 so that the beverage 31 can be effectively directed towards a reservoir for drinking.

The present invention also includes a bellow section 40 disposed within the body 20 and includes a conduit 41 having opposed end portions 42 disposed adjacent one chamber 21 and within a beverage bottle reservoir 30 respectively. The bellow section 40 cooperates with the spout 22 for moving between expanded and contracted positions so that air can be drawn upwardly through the conduit 41 and expelled through the spout 22. The bellow section 40 further has a passageway 43 extending substantially parallel to the axis for selectively drawing air outwardly from the reservoir 30.

The bellow section 40 includes a slidable stop member 44 that has a longitudinal axis aligned with the axis of the body 20. A helical spring 45 is disposed about the stop member 44, causing the stop member 44 to return downwardly towards a rested position when the lever 50 is released after it is compressed. The stop member 44 has a cradle 46 formed generally medially thereof for advantageously receiving the first flange section 51 of the lever 50 (described hereinbelow). The bellow section 40 further includes a gasket 47 connected to a lower portion 48 of the stop member 44 and is removably engageable with an upper portion 49 of the conduit 41.

The apparatus 10 also includes a plunger section 60 slidably connected to the body 20 for operably introducing pressure downwardly from another one of the plurality of chambers 21 and through the one chamber 21 and into the reservoir 30 underneath the bellow section 40. The plunger section 60 further includes a plunger 61 that has a substantially planar top surface 62 including a plate 63 for defining a lower surface 64 thereof. The plunger section 60 also includes a guide member 65 extending downwardly from a top portion 24 of the body 20 and substantially parallel to the axis so that the plunger 61 can pass through the guide member 65.

A washer 66 is connected to the plate 63 and has an outer perimeter engageable with an inner surface 25 of the body 20 so that air can be effectively compressed or released between the chamber 21 and the reservoir 30. The compression of air within the reservoir 30 advantageously prevents the Carbon Dioxide gas used to carbonate the beverage 31 from escaping into the void left in the bottle 30 by previously expelled beverage 31. This allows the beverage 31 to stay carbonated and "fizzy" for longer periods of time than a conventional bottle 30 would permit.

Figure 4:
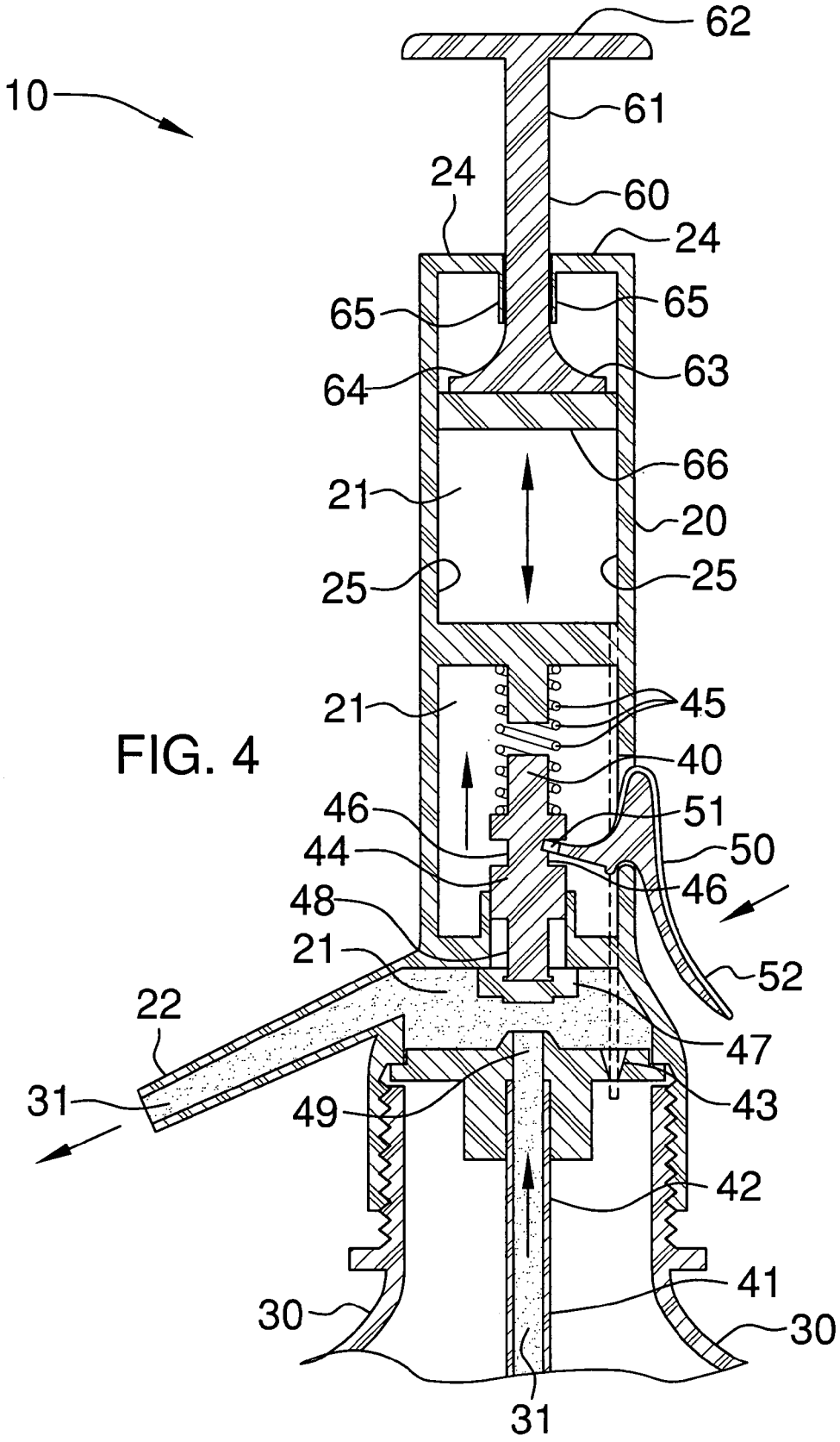
FIG. 4 is a partially enlarged view of FIG. 3 when the lever is at a compressed position.
Figure 5:
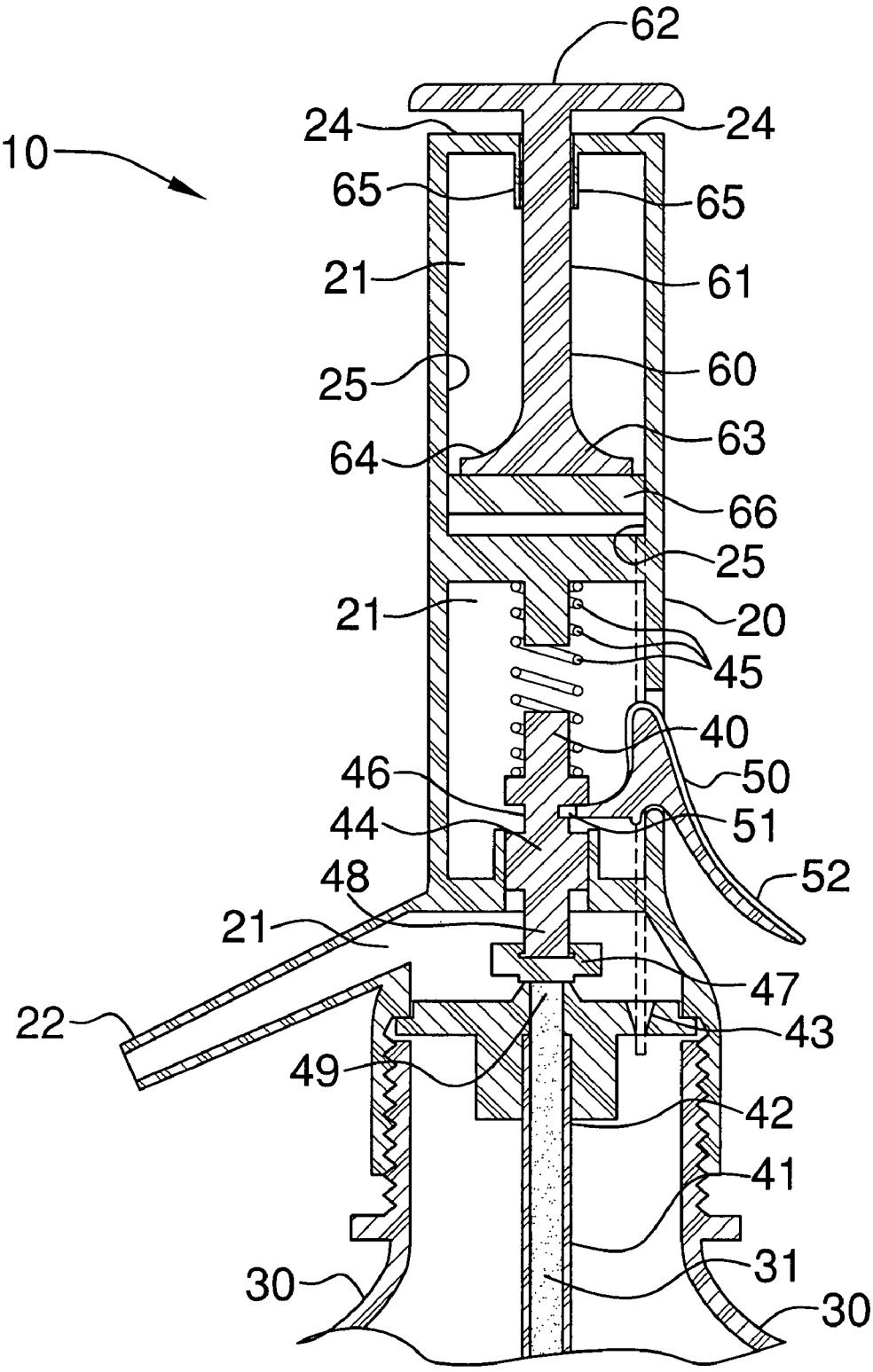
FIG. 5 is a partially enlarged view of FIG. 3 when the lever is at a released position.

The present invention further includes a lever 50 including a first flange portion 51 adjustably engaged with the bellow section 40 and further including a second flange portion 52 extending outwardly from the body 20. Referring to FIG. 4 and FIG. 5 respectively, the second flange portion 52 is movable between compressed and released positions for selectively releasing pressure from the reservoir 30 respectively.

The appealing features of the pressurized dispenser for beverage bottles are its small size, simplicity, convenience and ease of use. The apparatus 10 is installed on a bottle 30 with the same ease as a conventional bottle cap. The small size and simplicity of the apparatus 10 endows it with a relatively modest price, affordable by all individuals. Persons living by themselves, who consume carbonated beverages, will appreciate the apparatus' 10 feature of preserving carbonation over extended periods of time, since they might not consume an entire beverage bottle 30 in the same amount of time as family.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus securable to a top opening of a carbonated beverage bottle and for selectively dispensing fluid therefrom, said apparatus comprising:

a body having a substantially cylindrical shape and a centrally disposed longitudinal axis, said body further having a plurality of chambers vertically aligned along the axis;

a spout extending outwardly from one said plurality of chambers and being in fluid communication therewith;

a bellow section disposed within said body comprising a conduit having opposed end portions disposed adjacent said one chamber and within a beverage bottle reservoir respectively, said bellow section cooperating with said spout for moving between expanded and contracted positions so that air can be drawn upwardly through said conduit and expelled through said spout, said bellow section having a passageway extending substantially parallel to the axis and for selectively drawing air outwardly from the reservoir;

a plunger section slidably connected to said body and for operably introducing pressure downwardly from another said plurality of chambers and through said one chamber and into the reservoir underneath said bellow section; and a lever including a first flange portion adjustably engaged with said bellow section and further including a second flange portion extending outwardly from said body, said second flange portion being movable between compressed and released positions for selectively releasing pressure from the reservoir respectively;

wherein said bellow section comprises a slidable stop member having a longitudinal axis aligned with the axis of the body; and a helical spring disposed about said stop member and for causing said stop member to return downwardly towards a rested position when said lever is released after being compressed.

2. The apparatus of claim 1, wherein said stop member has a cradle formed generally medially thereof for receiving said first flange section of said lever.

3. The apparatus of claim 1, wherein said bellow section further comprises: a gasket connected to a lower portion of said stop member and being removably engageable with an upper portion of said conduit.

4. The apparatus of claim 1, wherein said plunger section further comprises:

a plunger having a substantially planar top surface and including a plate for defining a lower surface thereof;

a guide member extending downwardly from a top portion of said body and substantially parallel to the axis, said plunger passing through said guide member; and a washer connected to said plate and having an outer perimeter engageable with an inner surface of said body so that air can be effectively compressed or released from said another chamber and the reservoir.

5. The apparatus of claim 1, wherein said spout has a longitudinal axis offset at an oblique angle from the axis of said body.

6. An apparatus securable to a top opening of a carbonated beverage bottle and for selectively dispensing fluid therefrom, said apparatus comprising:

a body having a substantially cylindrical shape and a centrally disposed longitudinal axis, said body further having a plurality of chambers vertically aligned along the axis;

a spout extending outwardly from one said plurality of chambers and being in fluid communication therewith;

a bellow section disposed within said body comprising a conduit having opposed end portions disposed adjacent said one chamber and within a beverage bottle reservoir respectively, said bellow section cooperating with said spout for moving between expanded and contracted positions so that air can be drawn upwardly through said conduit and expelled through said spout, said bellow section having a passageway extending substantially parallel to the axis and for selectively drawing air outwardly from the reservoir;

a plunger section slidably connected to said body and for operably introducing pressure downwardly from another said plurality of chambers and through said one chamber and into the reservoir underneath said bellow section; and a lever including a first flange portion adjustably engaged with said bellow section and further including a second flange portion extending outwardly from said body, said second flange portion being movable between compressed and released positions for selectively releasing pressure from the reservoir respectively;

wherein said bellow section comprises a slidable stop member having a longitudinal axis aligned with the axis of the body; and a helical spring disposed about said stop member and for causing said stop member to return downwardly towards a rested position when said lever is released after being compressed;

wherein said stop member has a cradle formed generally medially thereof for receiving said first flange section of said lever.

7. The apparatus of claim 6, wherein said bellow section further comprises: a gasket connected to a lower portion of said stop member and being removably engageable with an upper portion of said conduit.

8. The apparatus of claim 6, wherein said plunger section further comprises:

a plunger having a substantially planar top surface and including a plate for defining a lower surface thereof;

a guide member extending downwardly from a top portion of said body and substantially parallel to the axis, said plunger passing through said guide member; and a washer connected to said plate and having an outer perimeter engageable with an inner surface of said body so that air can be effectively compressed or released from said another chamber and the reservoir.

9. The apparatus of claim 6, wherein said spout has a longitudinal axis offset at an oblique angle from the axis of said body.

10. An apparatus securable to a top opening of a carbonated beverage bottle and for selectively dispensing fluid therefrom, said apparatus comprising:

a body having a substantially cylindrical shape and a centrally disposed longitudinal axis, said body further having a plurality of chambers vertically aligned along the axis;

a spout extending outwardly from one said plurality of chambers and being in fluid communication therewith, said spout having a longitudinal axis offset at an oblique angle from the axis of said body;

a bellow section disposed within said body comprising a conduit having opposed end portions disposed adjacent said one chamber and within a beverage bottle reservoir respectively, said bellow section cooperating with said spout for moving between expanded and contracted positions so that air can be drawn upwardly through said conduit and expelled through said spout, said bellow section having a passageway extending substantially parallel to the axis and for selectively drawing air outwardly from the reservoir;

a plunger section slidably connected to said body and for operably introducing pressure downwardly from another said plurality of chambers and through said one chamber and into the reservoir underneath said bellow section; and a lever including a first flange portion adjustably engaged with said bellow section and further including a second flange portion extending outwardly from said body, said second flange portion being movable between compressed and released positions for selectively releasing pressure from the reservoir respectively;

wherein said bellow section comprises a slidable stop member having a longitudinal axis aligned with the axis of the body; and a helical spring disposed about said stop member and for causing said stop member to return downwardly towards a rested position when said lever is released after being compressed;

wherein said stop member has a cradle formed generally medially thereof for receiving said first flange section of said lever.

11. The apparatus of claim 10, wherein said bellow section further comprises: a gasket connected to a lower portion of said stop member and being removably engageable with an upper portion of said conduit.

12. The apparatus of claim 10, wherein said plunger section further comprises:

a plunger having a substantially planar top surface and including a plate for defining a lower surface thereof;

a guide member extending downwardly from a top portion of said body and substantially parallel to the axis, said plunger passing through said guide member; and a washer connected to said plate and having an outer perimeter engageable with an inner surface of said body so that air can be effectively compressed or released from said another chamber and the reservoir.

* * * * *